US006883347B2

(12) United States Patent
Ayub

(10) Patent No.: US 6,883,347 B2
(45) Date of Patent: Apr. 26, 2005

(54) END BONNETS FOR SHELL AND TUBE DX EVAPORATOR

(76) Inventor: Zahid Hussain Ayub, 3305 Throntree Ct., Arlington, TX (US) 76016

( * ) Notice: Subject to any disclaimer, the term of this patent is extended or adjusted under 35 U.S.C. 154(b) by 13 days.

(21) Appl. No.: 10/667,402

(22) Filed: Sep. 23, 2003

(65) Prior Publication Data

US 2005/0061025 A1 Mar. 24, 2005

(51) Int. Cl.[7] ..... F25B 39/02; F28D 7/00

(52) U.S. Cl. ..... 62/515; 62/524; 165/159; 165/160

(58) Field of Search ..... 62/515, 524, 526, 62/506; 165/144, 157, 159, 160

(56) References Cited

U.S. PATENT DOCUMENTS 1,813,234 A 7/1931 Dodd
2,596,195 A 5/1952 Arbuckle
2,762,611 A * 9/1956 Monroe et al. ..... 277/606
3,527,290 A 9/1970 Lossing
3,802,496 A 4/1974 Ris et al.
4,805,694 A 2/1989 Ayub
2002/0157417 A1 * 10/2002 Iritani et al. ..... 62/515

* cited by examiner

*Primary Examiner*—Chen Wen Jiang
(74) *Attorney, Agent, or Firm*—Geoffrey A. Mantooth

(57) ABSTRACT

The end bonnets for a dry expansion heat exchanger of the shell and tube type having a plurality of bundles of tubes. A pair of end bonnets on opposite ends of the shell. Vertical flat impingement plates between the horizontal baffle ribs within the bonnets subdivide the bonnets into subchambers corresponding to the tube count in respective tube bundles. The cross-sectional areas of successive bundles of tubes increase to allow for expansion of the coolant as it flows through the heat exchanger and absorbs heat from the fluid to be cooled. The vertical plates in the end bonnets define restricted flow areas for the coolant which increases in flow area corresponding to the respective tube bundles.

12 Claims, 1 Drawing Sheet

END BONNETS FOR SHELL AND TUBE DX EVAPORATOR

FIELD OF INVENTION

The present invention relates to Shell and Tube DX Evaporators for refrigeration applications.

BACKGROUND OF THE INVENTION

The present invention relates to end bonnets for use in a shell and tube evaporator. Shell and tube dry expansion also called direct expansion (DX) evaporator is an integral part of a refrigeration system. In a typical refrigeration system there is an evaporator that cools the process fluid at the expense of boiling the refrigerant that is at a lower saturation temperature and pressure, a compressor that compresses the boiled off refrigerant to an elevated pressure and temperature, a condenser that condenses the high pressure refrigerant to liquid phase at the expense of heating the cooling medium, and an expansion device that drops down the pressure of the condensed refrigerant back to the low side which then enters the evaporator to repeat the above cycle again. This cycle is called the reverse Rankine cycle.

A shell and tube DX evaporator generally provide a counter or cross flow arrangement for the cooling process fluid in the shell body by a refrigerant (coolant fluid) passing through the tubing within a shell body, which is frequently cylindrically shaped. This tubing provides communication between sealed opposite ends of the cylindrically shaped configuration and defines a flow path for communication of the refrigerant from end to end of the shell structure. The tubes terminate at an end plate commonly known as tube sheets at either end of the shell and bonnet is provided at either end of this shell to define a transfer chamber for fluid communication between successive sets of tubes at each end of the shell.

Evaporators in a refrigeration cycle are generally utilized for cooling various fluids, which may be either gaseous or liquid, by refrigerant transferred through the tube arrangements. As it picks up heat from the fluid to be chilled, the coolant fluid will boil or vaporize as it flows through the tubing network extending between the bonnets. Initially during the cooling cycle, the cooling fluid is generally a liquid.

The tubes provide a tortuous path encompassing multiple passes of the coolant fluid through the shell and, as it continues to increase in temperature, the cooling fluid expands. As the cooling fluid proceeds through each successive or sequential pass, there will be a change of state for the fluid from liquid to the gaseous state. This change of state requires an expanded tube volume to accommodate the expanding cooling fluid. Therefore, subsequent cooling passes require an increased number of tubes or larger cross-sectional area tubes to transfer the initial fluid volume through the heat exchanger network of tubes. Failure to provide this increased fluid transfer volume, as the coolant fluid temperature increases until it attains the vapor state, would result in high fluid velocities in the tubes and large back pressure. In addition, problems relating to the fluid distribution result from these pressure-temperature changes.

Abrupt increases in flow areas causes large pressure drops within the evaporators and results in decreases in pressure and thus reduction in the boiling point of the refrigerant. This characteristic indicative of a phenomenon referred to as flashing. Flashing refers to the transition from liquid to the gaseous phase due to the drop in saturation temperature. Therefore, it is desirable to limit the loss of cooling capacity due to flashing.

Bonnets of varying designs have been provided for aiding and improving fluid flow, which designs include the utilization of U-shaped return passages and inlet and outlet passages in alignment with the tubes within the housing for providing a continuous flow path through the tubes. These U-shaped passages may be provided in a flat-plate type end bonnet. However, such U-tubes are very expensive and difficult to maintain. Other prior art evaporators employ hemi spherically shaped bonnets that are subdivided by partitions or baffle plates between the flange and the contoured inner surface of the bonnet. These baffle plates thus provide transfer chambers in the bonnet between successive tube bundles of the tube network. However, the abrupt increase in flow area in the bonnets causes undesirable pressure drops.

SUMMARY OF THE INVENTION

The present invention encompasses bonnets of a shell and tube evaporator having sub chambers for flow reversal of a refrigerant between successive tube bundles.

The bonnets incorporate horizontal baffles which divide the hemispherical compartment into multiple chambers for fluid communication for each sequentially arranged tube bundle set. Vertical connecting plates between adjacent horizontal baffles are provided in each fluid transfer chamber to create a sub chamber, which sub chamber defines a gap between the flange and this vertical plate located between the flange end and the inner surface of the bonnet. The gap in the sub chamber has a cross-sectional area substantially equal to the total cross-sectional area of the tube bundles upstream of and leading into the fluid transfer bonnet sub chamber. Thus, the refrigerant flowing through the tubes and into the bonnet chamber is presented with a flow restriction that is equal in cross-sectional area to the cross-sectional area of the combined tubes making up the tube bundle flowing into the sub chamber. This avoids the large pressure drop that results in prior art heat exchangers wherein the saturated refrigerant expands rapidly into a very large volume, thereby flashing and reducing efficiency of the evaporator and hence resulting in refrigerant flow mal-distribution. The refrigerant then flows through this sub chamber to enter the next bundle of tubes which has larger number of tubes than the preceding bundle and flows to the opposite end of the evaporator and encounters another chamber having a vertical plate between adjacent horizontal baffles which creates another sub chamber having a cross-sectional area substantially equal to the combined cross-sectional areas of the tubes in the second bundle.

Because the refrigerant is absorbing heat, it is gradually expanding and changing from liquid to gaseous state, thereby necessitating a larger number of tubes in each successive bundle. The vertical plates between adjacent horizontal baffles in each bonnet that forms a sub chamber are also sequentially spaced further away from the flange end so as to form a gap that creates a turn-around flow area substantially matching the cross-sectional area of the bundle of tubes flowing into the particular sub chamber in question. This continues throughout the evaporator with the refrigerant flowing, on each pass, through larger numbers of tubes or bundles having larger cross-sectional areas as the refrigerant expand until it flows out of the evaporator. The invention is applicable to evaporators of any number of stages wherein the sub chambers in the end bonnets presents increasingly larger cross-sectional flow areas to the refrigerant as it flows through tube bundles having larger cross-sectional areas.

The invention relates to end bonnets in a shell and tube evaporator that incorporates a plurality of bundles of tubes extending from one end of the shell to the other. A first flow reversing bonnet is mounted on one end of the shell and a second flow reversing bonnet is mounted on the other end of the shell, each of the bonnets having at least one flow reversing chamber in fluid communication with two bundles of tubes. The chambers and tubes are arranged serially along the flow path of the refrigerant which flows through the evaporator whereby it flows from the inlet through a bundle of tubes into one chamber, then reverses direction and flows through another bundle of tubes to the next chamber, and so on until the refrigerant has flowed through the entire evaporator and exits the discharge outlet. Each chamber has a vertical plate that creates a sub chamber. The tube bundles aligned with successive sub chambers have increasingly larger cross-sectional flow areas.

DETAILED DESCRIPTION OF THE INVENTION

Figure 1:
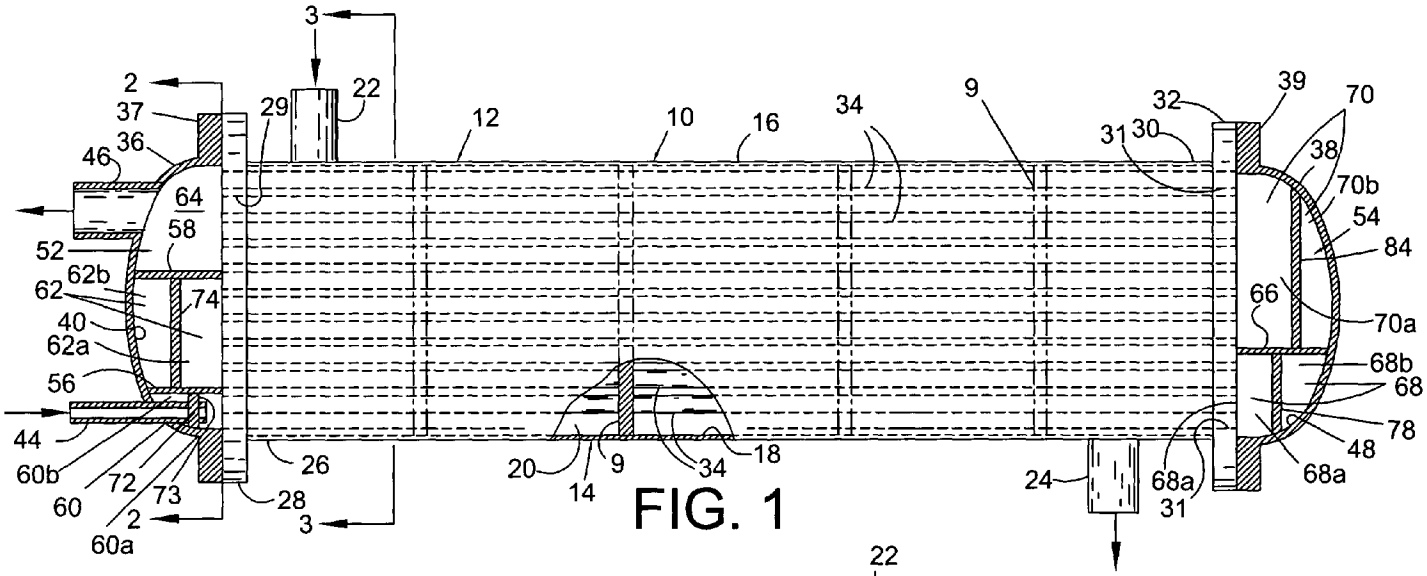
FIG. 1 is a diagrammatic elevation view of a shell and tube DX evaporator with elliptical bonnets in cross-section.

A dry expansion (DX) shell and tube evaporator 10 with hemispherical end bonnets is illustrated in FIG. 1. Evaporator 10 includes a shell 12 with a wall 14 having an outer surface 16 and an inner surface 18, a generally cylindrically shaped chamber 20, a process fluid inlet port 22 through wall 14 to chamber 20, and a process fluid outlet port 24. Shell 12 has a first end 26 with a first plate also commonly known as tube sheet 28, and a second end 30 with a second tube sheet 32.

First tube sheet 28 and second tube sheet 32 are provided with a plurality of openings 29 and 31, respectively, in axial alignment generally parallel to the longitudinal axis of shell 12. A plurality of tubes 34 are positioned in chamber 20, supported by support plates 9 with plurality of openings as in 28 and 32 within 20 and at their ends in openings 29 and 31 in tube sheets 28 and 32, respectively.

A first bonnet 36 having flange 37 is mounted on tube sheet 28 and secured thereto by means known in the art, such as bolts or clamps, and a second bonnet 38 having flange 39 is similarly mounted on tube sheet 32. First bonnet 36 includes inner surface 40, refrigerant inlet 44 and outlet 46. Second bonnet 38 has an inner surface 48. Bonnets 36 and 38 cooperate with tube sheets 28 and 32 to define first and second fluid transfer chambers 52 and 54, respectively.

As shown in FIG. 1, horizontal baffle plates 56 and 58 are disposed in chamber 52 between first tube sheet 28 and end surface 40 of first bonnet 36 to define fluid chambers 60, 62, and 64 in bonnet 36. A similar horizontal baffle plate 66, which is mounted in second chamber 54 between second tube sheet 32 and inner surface 48 of bonnet 38, separates bonnet 38 into chambers 68 and 70.

A vertical flat plate 72 is attached between horizontal baffle 56 and the inner surface 40 of bonnet 36 so that sub chambers 60*a* and 60*b* are formed. The inlet port 44 protrudes through a hole in vertical plate 72 and is welded on side 73 of 72 to isolate sub chamber 60*a* from 60*b*. Similarly a vertical plate 74 is mounted between horizontal baffles 56 and 58 extending towards the inner surface 40 of bonnet 36 so that sub chambers 62*a* and 62*b* are formed. A vertical flat plate 78 is attached between horizontal baffle 66 and the inner surface 48 of bonnet 38 so that sub chambers 68*a* and 68*b* are formed. Similarly a vertical plate 84 is mounted between horizontal baffle 66 and the inner surface 48 of bonnet 38 so that sub chambers 70*a* and 70*b* are formed.

Figure 3:
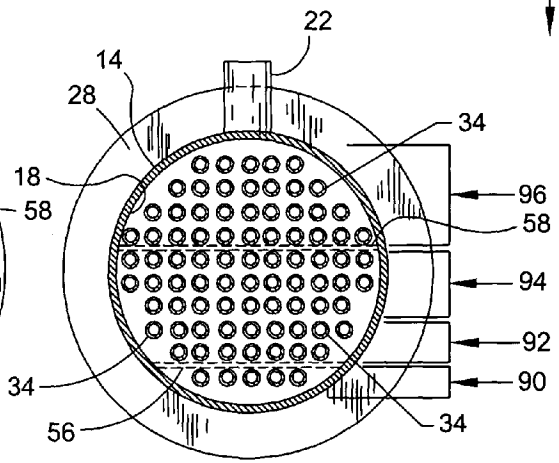
FIG. 3 is a sectional view taken along line 3—3 of FIG. 1 and viewed in the direction of the arrows.
Figure 2:
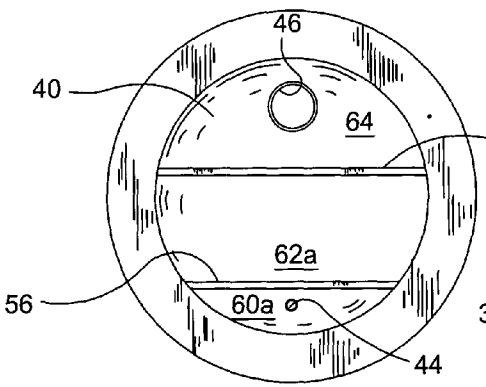
FIG. 2 is a sectional view of the bonnet taken along the line 2—2 in FIG. 1 and viewed in the direction of the arrows.

As an example of a tube bundle arrangement, the tubes 34 (FIG. 3) are divided, from bottom to top in the figure, in sequentially increasing numbers of tubes from 5 tubes to 32 tubes per bundle, which illustrates an increasing diametric flow path for the fluid flowing from inlet port 44 to discharge port 46. The tube bundles or tube sets are consecutively numbered 90, 92, 94 and 96 (FIG. 3). Tube bundle 90 communicates with tube bundle 92 via sub chamber 60*a*, which receives incoming refrigerant from inlet port 44, and sub chamber 68*a*; tube bundle 92 further communicates with tube bundle 94 via sub chamber 68*a* and sub chamber 62*a*; tube bundle 94 further communicate with tube bundle 96 via sub chamber 62*a* and sub chamber 70*a*. Thus, the cross-sectional flow area of the sequential tube bundles 90–96 communicating refrigerant from end-to-end in this sequential arrangement increases between inlet port 44 and discharge port 46. The increasing number of tubes per bundle accommodates the expansion of the refrigerant transferred between the sub chambers, where the refrigerant is being used to cool a process fluid introduced through port 22 to shell chamber 20. This sequential increase in the flow areas is accordingly matched with the respective sub chamber turn around flow areas as defined by the vertical plates and the tube sheets. Therefore, sub chamber 60*a* is smaller than sub chamber 68*a* which is smaller than 62*a* and which is in turn smaller than 70*a*.

In operation, refrigerant is introduced into the tube bundle network through inlet 44 and is sequentially passed through tube bundles 90, 92, 94 and 96 for discharge from outlet 46 to a re-circulating network (not illustrated). As the process fluid is introduced through inlet 22 into shell chamber 20, it passes over tubes 34 for cooling and subsequent discharge through discharge outlet 24. As the refrigerant communicates through the tube bundles 90, 92, 94 and 96, it passes through sub chambers 68*a*, 62*a*, and 70*a*, in that order as shown in FIG. 1. These sub chambers present relatively constant cross-sectional flow areas equal to the cross sectional area of the tubes entering into the respective sub chambers, therefore promoting streamline flow between the sequential tube bundles 90, 92, 94 and 96. Thus, the refrigerant, either liquid or gas, as it flows through the evaporator, does not experience radical pressure drops or back pressures in the head or bonnet chambers and there is better distribution of the fluid through each bundle. Control of the pressure drops and fluid flow characteristics reduces the potential for flashing and other undesirable consequences in the fluid transfer chambers, i.e., mal-distribution.

The tubing network, baffle and vertical plate arrangement described above is significantly less expensive, easier to manufacture, assemble and maintain than earlier exchangers as no U-tubes or tortuous channels or passages need to be machined in the bonnets. The technology for the manufacture of these elliptical bonnets or hemispherical heads is known and relatively inexpensive. The tubing network illustrated and discussed above is exemplary and not limiting. The inlet port 44 and exit port 46 may be provided in opposite bonnets and the number of refrigerant passes in the tubing network is a design choice.

While only a particular embodiment of the invention has been described and claimed herein, it is apparent that various modifications and alterations of the invention may be made. It is therefore the intention in the appended claims to cover all such modifications and alterations as may fall within the true spirit and scope of the invention.

What is claimed is:

1. A heat exchanger, comprising:

a) a shell having a first fluid inlet and a first fluid outlet, and having first and second ends;

b) a plurality of tubes located in the shell and extending horizontally between the first and second shell ends;

c) a tube sheet located at each of the first and second shell ends, the tube sheet allowing the tubes to pass therethrough;

d) each of the first and second shell ends having a bonnet located thereon, with at least one of the bonnets having a second fluid inlet and a second fluid outlet;

e) a wall located in the bonnet with the second fluid inlet, the wall forming a chamber, which chamber allows communication between the second fluid inlet and at least some of the tubes that provide an exit from the chamber, the wall being separated from the adjacent tube sheet by a distance so as to form a cross-sectional area of the chamber that is substantially equal to the cross-sectional area of the tubes exiting the chamber.

2. The heat exchanger of claim 1, wherein the bonnets are domes.

3. The heat exchanger of claim 1, wherein the wall comprises a horizontal portion and a vertical portion, with the vertical portion being separated from the adjacent tube sheet by a distance so as to form the cross-sectional area of the chamber.

4. A heat exchanger, comprising:

a) a shell having a first fluid inlet and a first fluid outlet, and having first and second ends;

b) a plurality of tubes located in the shell and extending horizontally between the first and second shell ends;

c) a tube sheet located at each of the first and second shell ends, the tube sheet allowing the tubes to pass therethrough;

d) each of the first and second shell ends having a bonnet located thereon, with at least one of the bonnets having a second fluid inlet and a second fluid outlet;

e) at least one wall located in at least one of the bonnets, the wall forming a chamber between the tube sheet and the wall, the chamber having some of the tubes leading into the chamber and other of the tubes exiting from the chamber;

f) the wall being spaced from the tube sheet by a distance so as to form a cross-sectional area that is substantially equal to the cross-sectional area of the tubes leading into the chamber.

5. The heat exchanger of claim 4, wherein the bonnets are domes.

6. The heat exchanger of claim 4, wherein the wall comprises a horizontal portion and a vertical portion, with the vertical portion being separated from the adjacent tube sheet by a distance so as to form the cross-sectional area of the chamber.

7. A heat exchanger, comprising:

a) a shell having a first fluid inlet and a first fluid outlet, and having first and second ends;

b) a plurality of tubes located in the shell and extending horizontally between the first and second shell ends;

c) a tube sheet located at each of the first and second shell ends, the tube sheet allowing the tubes to pass therethrough;

d) each of the first and second shell ends having a bonnet located thereon, with at least one of the bonnets having a second fluid inlet and a second fluid outlet;

e) at least one baffle located in each of the bonnets, the baffle extending from the tube sheet and forming chambers in the respective bonnet;

f) some of the chambers forming turnarounds and having some of the tubes leading thereinto and other of the tubes exiting therefrom;

g) the turnaround chambers having a wall that is spaced from the respective tube sheet so as to form a cross-sectional area that is substantially equal to the cross-sectional area of the tubes leading into the subchamber.

8. The heat exchanger of claim 7, wherein the bonnets are domes.

9. The heat exchanger of claim 7, wherein the turnaround chambers change size and cross-sectional area successively in the flow direction of the second fluid.

10. The heat exchanger of claim 7, wherein the turnaround chambers are progressively larger in the flow direction of the second fluid.

11. The heat exchanger of claim 7, wherein the heat exchanger is of the DX type.

12. The heat exchanger of claim 7, wherein baffles form chords in the domed bonnets.

* * * * *